United States Patent [19]

Calet

[11] 4,441,679

[45] Apr. 10, 1984

[54] POST ASSEMBLY

[76] Inventor: Rudolph J. Calet, 1179 Berwin Ave., Akron, Ohio 44310

[21] Appl. No.: 356,091

[22] Filed: Mar. 8, 1982

[51] Int. Cl.[3] ..... A45F 3/44

[52] U.S. Cl. ..... 248/156; 40/607

[58] Field of Search ..... 40/607, 10 PM, 124.5; 248/156; 52/103

[56] References Cited

U.S. PATENT DOCUMENTS

| | | | |
|---|---|---|---|
| 736,181 | 8/1903 | Weglein | 40/607 |
| 823,441 | 6/1906 | Robinson . | |
| 965,566 | 7/1910 | Cooley | 40/607 |
| 1,705,742 | 3/1929 | Werner . | |
| 2,167,564 | 7/1949 | Fonda | 40/607 |
| 2,593,468 | 4/1952 | Marsh | 40/124.5 |
| 3,655,160 | 4/1972 | Grillot | 248/188.8 |
| 3,809,346 | 5/1974 | Jackson | 248/44 |
| 3,809,348 | 5/1974 | DiLaura | 248/49 |
| 3,840,203 | 10/1974 | Sheehy | 248/188.8 |
| 4,258,494 | 3/1981 | Borque | 40/607 |
| 4,327,514 | 5/1982 | Bourque | 40/607 |

FOREIGN PATENT DOCUMENTS

| | | | |
|---|---|---|---|
| 1140970 | 8/1957 | France | 40/607 |
| 35236 | 4/1935 | Netherlands . | |

*Primary Examiner*—Gene Mancene
*Assistant Examiner*—Wenceslao J. Contreras
*Attorney, Agent, or Firm*—Frederick K. Lacher

[57] ABSTRACT

A sign post assembly having an elongated post with a hollow end for positioning over a base member which is secured to the ground by base rod members slidably mounted in the base member and driven into the ground. A post rod member is connected to the hollow end of the post for holding the post on the base member. The post may have bowed walls and a longitudinally extending rib for increased rigidity. The base member may have a cruciform or rectangular cross section with longitudinally extending sleeves in diagonally opposite corner portions for the base rod members. The cross arm may also have a longitudinally extending rib for stiffening the arm and providing a groove for an upper sign. A tab may be provided extending outward from the hollow end of the post and have an opening through which the post rod member may be driven into the ground.

8 Claims, 8 Drawing Figures

POST ASSEMBLY

BACKGROUND OF THE INVENTION

This invention relates to posts and especially to a sign post having a cross arm for supporting a hanging sign. This type of sign has been very effective for selling. Heretofore the signs have been made of wood and have been heavy to transport. The installation and removal of the signs has also required the services of a sign installer which has been relatively expensive.

Efforts have been made to substitute a hollow post made of lightweight plastic material for the solid wood post. In one application, the hollow post is placed over a steel stake. However, special equipment has been necessary to drive the stake in the ground and remove it. Also the steel stake has been relatively heavy in order to withstand the forces it is subjected to during installation and removal.

SUMMARY OF THE INVENTION

The present invention is directed to a post assembly which is lightweight and may be installed and removed with a minimum of effort. At the same time the assembly has the necessary strength and rigidity to support a sign under adverse weather conditions.

Therefore, in accordance with an aspect of this invention there is provided a post assembly for mounting vertically on an earthen surface comprising a post member having a hollow end, a base member slidably positioned in said hollow end, said base member having at least two openings and elongated base supporting members disposed in said openings and extending beyond said post member for penetration into the earthen surface and at least one post securing member engageable with said post member for preventing movement of said base member out of said hollow end.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be emploued.

DETAILED DESCRIPTION

Figures 1, 2:
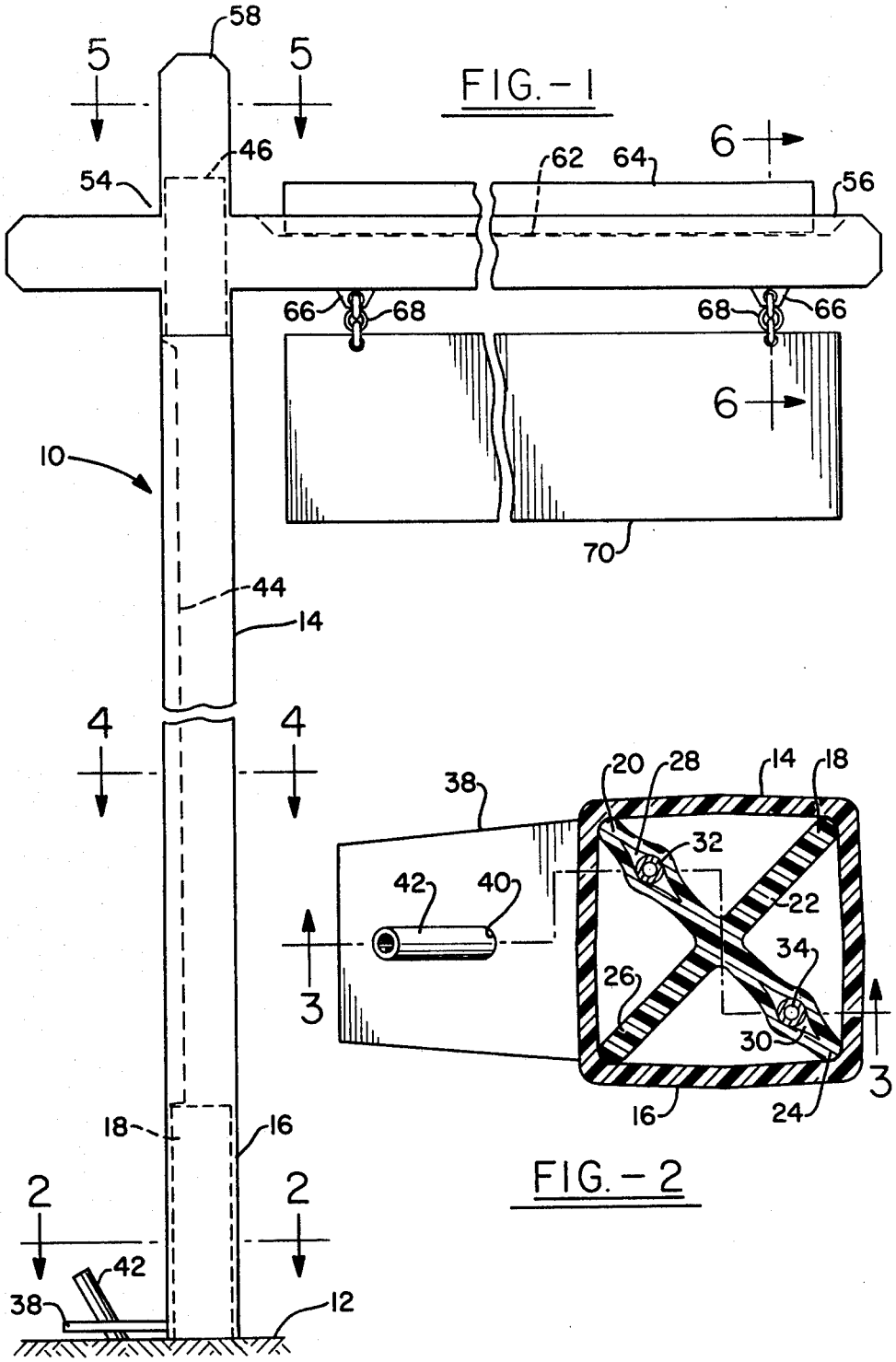
FIG. 1 is a side elevation of a sign post assembly embodying the invention with pieces of the post, cross arm and signs broken out.
FIG. 2 is an enlarged sectional view taken along the line 2—2 in FIG. 1.

Referring to FIG. 1, a post assembly 10 is shown mounted on an earthen surface 12. The post assembly 10 has a post member such as post 14 which has a hollow end 16 for positioning over a base member 18 shown more clearly in FIGS. 2 and 3. The hollow end 16 has a generally square cross section and the base member 18 has a cruciform shape with arms 20, 22, 24 and 26 extending from a central connection to the corners of the hollow end. At least two of the arms 20 and 24 have longitudinally extending openings 28 and 30 through which base supporting members such as metal rods or pipes 32 and 34 are positioned and driven through the earthen surface 12 into ground 36 as shown more clearly in FIG. 3.

Projecting from the hollow end 16 of the post 14 at a position close to the earthen surface 12 is an anchor tab 38 having at least one opening 40 through which an elongated post securing member such as a metal rod or pipe 42 extends and may be driven through the earthen surface into the ground 36 at an angle A to the vertical for preventing movement of the hollow end 16 upward off the base member 18. The opening 40 is drilled so that the pipe 42 may be at a suitable angle A of from about thirty degrees to about forty-five degrees.

Figure 4:
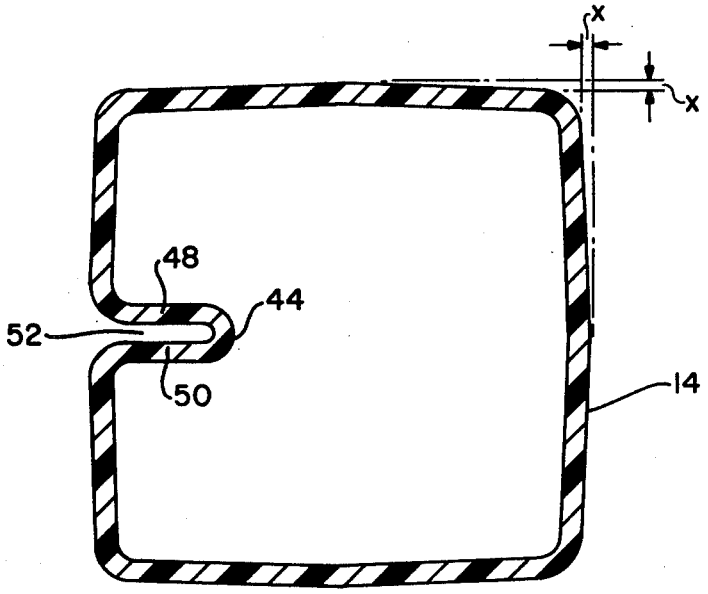
FIG. 4 is an enlarged detailed sectional view taken along the line 4—4 in FIG. 1.

As shown in FIGS. 1 and 4, the post 14 has a reinforcing rib 44 which extends vertically between opposite sides of the post from the hollow end 16 to a position spaced from an upper end 46. The rib 44 may have two webs 48 and 50 separated by a groove 52 for convenience of manufacture.

Figure 5:
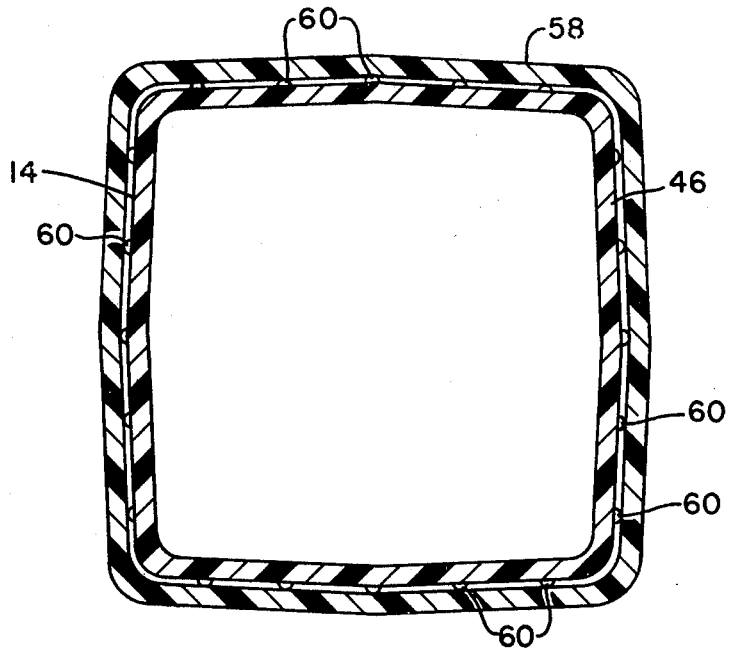
FIG. 5 is a detailed sectional view similar to FIG. 4 taken along the line 5—5 in FIG. 1.

A cross arm member 54 is mounted on the upper end 46 and has a cross arm 56 extending in a generally horizontal position and a cap 58 extending in a generally vertical direction. As shown in FIGS 1 and 5, the upper end 46 of the post 14 has a reduced width and depth so as to fit within the hollow cap 58. Vertically extending and horizontally spaced splines 60 may be provided on the surface of the upper end 46 of the post 14 for engagement with the inner surface of the cap 58 as shown in FIG. 5. The splines 60 facilitate the sliding of the cap 58 over the upper end 46 of the post and then removing the cap when it is desired to disassemble the post assembly 10.

The cross arm 56 may have a longitudinally extending slot 62 in the upper surface for receiving a relatively small upper sign 64 and reinforcing the arm. Mounting means such as lugs 66 are formed on the lower surface of the cross arm 56 and have holes through which chain members 68 may be detachably connected to a lower sign 70.

Figure 6:
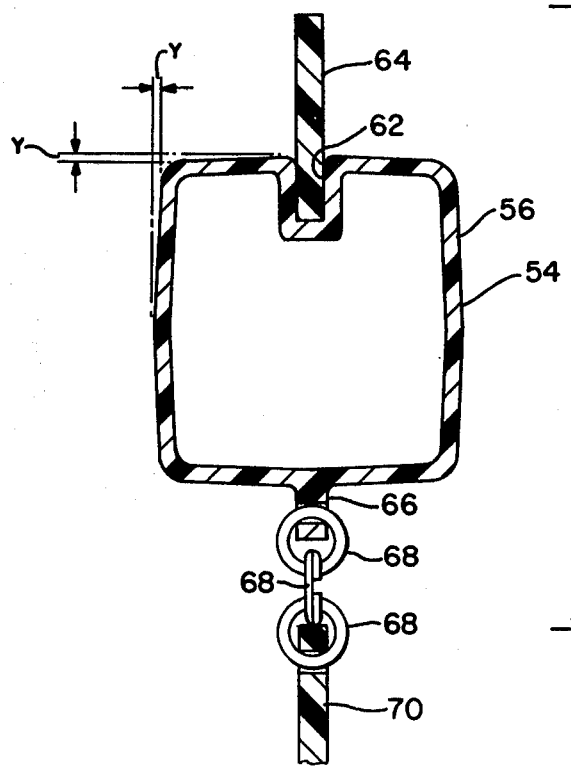
FIG. 6 is an enlarged fragmentary sectional view taken along the line 6—6 in FIG. 1.

Referring to FIGS. 4 and 6, the post 14 and cross arm 56 have bowed sides to provide a stiffening of the members and improved mold release. The sides of the post 14 and cross arm 56 are bowed out at the midcenter planes distances X and Y, respectively, of about one-sixteenth inch. Preferably, the cross arm member 54 and post 14 are of a thermoplastic material such as rigid vinyl and are made by rotational molding. In one size of post assembly 10, the post 14 is four feet, six inches long with the total length of the cross arm member 54 being forty-three inches. The cap 58 is twelve and three-sixteenths inches long and the cross arm 56 has a long section with a length of thirty-two inches and a short section with a length of seven inches. In a larger size of post assembly 10, the post 14 is five feet, one inch in length and the total length of the cross arm member 54 is fifty-one inches. The cap 58 is fourteen and three-sixteenths inches long and the cross arm 56 has a long section with a length of thirty-eight inches. The short section is nine inches long. In both of these assemblies, it is desirable to cant the long section of the cross arm 56 upwardly to compensate for the bending of the post 14 and cross arm assembly 54. With a wall thickness of the post 14 and cross arm assembly 54 of about one-eighth inch, the arm 56 for the larger size post may be canted upwardly about three-eighths inch.

The anchor tab 38 is positioned approximately one inch from the end of the post 14 and, for this embodiment, has a thickness of about one-quarter inch.

The base member 18 is also preferably of a thermoplastic material such as rigid vinyl and may be extruded in the cruciform shape shown in FIG. 2. For the larger size post assembly 10, the opening in the hollow end 16 has a width of three and three-eighths inches and it has been found that a desirable length for the base member 18 is about twenty-four inches. For the smaller size post assembly 10 having a hollow end 16 with an opening width of two and fifteen-sixteenths inches, the desirable length of the base member 18 has been about eighteen inches. The arms 22 and 26 have a thickness of about one-quarter inch and the walls of the arms 20 and 24 at the openings 28 and 30 have a thickness of about one-eighth inch.

Figure 3:
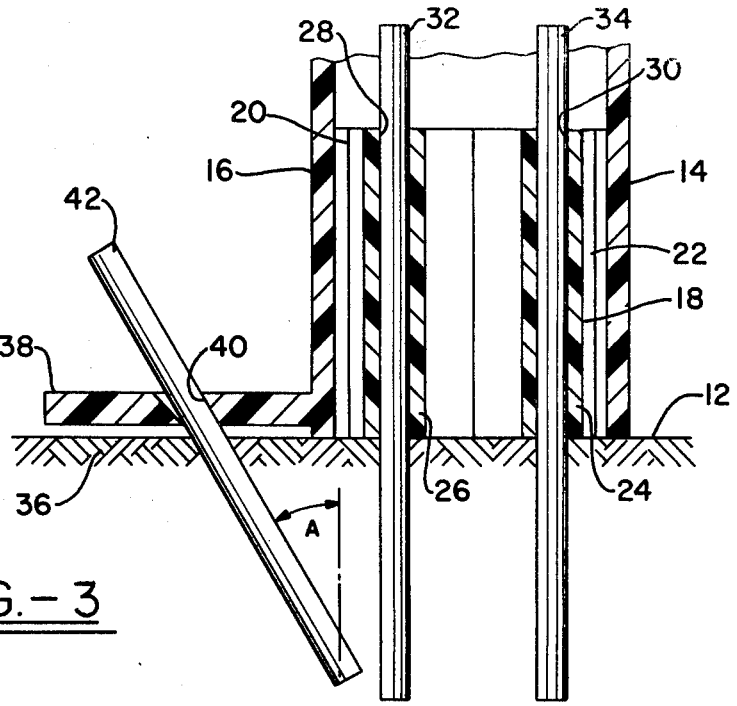
FIG. 3 is a fragmentary sectional view taken along the lines 3—3 in FIG. 2.

The pipes 32 and 34 are preferably of steel and have a diameter of about one-half inch and a length greater than the length of the base member 18 for driving in the ground 36 as shown in FIG. 3. The pipe 42 may also be of steel, have a diameter of one-half inch and extend through opening 40 in the anchor tab 38 having a diameter of about one-half inch. The pipe 42 has a length sufficient to drive into the ground 36 and under the base member 18, as shown in FIG. 3.

In operation, the post assembly 10 is mounted in position by placing the base member 18 in a vertical position on the surface 12 and driving pipes 32 and 34 through the openings 28 and 30 into the ground 36. The hollow end 16 of the post 14 is then placed over the base member 18 and the pipe 42 driven through the hole 40 in the anchor tab 38 into the ground 36 as shown in FIG. 3. The cap 58 of the cross arm member 54 is placed over the upper end 46 of the post 14 with the long section of the cross arm 56 extending horizontally outward in a direction opposite to the anchor tab 38. The sign 64 may then be placed in the slot 62 and the lower sign 70 fastened by chain members 68 to the lugs 66 on the cross arm 56. To disassemble the post, the upper sign 64 and lower sign 70 are removed from the cross arm 56. The cap 58 is lifted off the upper end 46 of the post 14. Then the pipe 42 is pulled out of the ground 36 through the opening 40 in the anchor tab 38 and the post 14 lifted off the base member 18. The pipes 32 and 34 are then pulled with the base member 18 out of the ground 36 or they may be pulled individually out of the ground through the openings 28 and 30. The post assembly 10 may then be transported to another location and assembled there.

Figure 7:
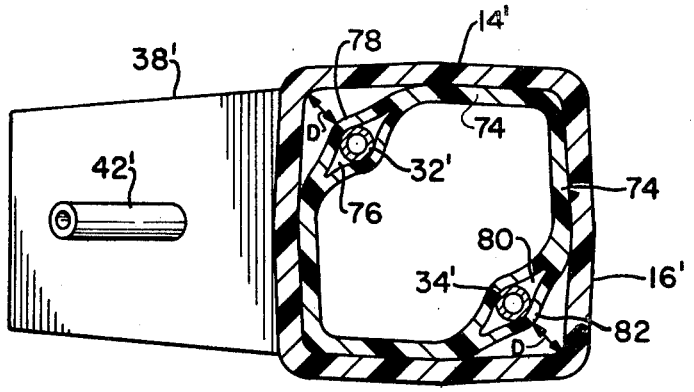
FIG. 7 is a fragmentary view like FIG. 2 showing an alternative form of base member.

Referring to FIG. 7, an alternative base member 72 is shown having a hollow, generally rectangular, cross section with a supporting wall 74 over which the hollow end 16' of the post 14' may be positioned. The base member 72 has a sleeve such as longitudinally extending opening 76 in the wall 74 at one corner portion 78 and a second sleeve such as second longitudinally extending opening 80 in the wall at a diagonally opposite corner portion 82. Elongated base supporting members such as pipes 32' and 34' are disposed in the openings 76 and 80 and may be driven into the ground 36 in the same manner as the pipes 32 and 34 are driven into the ground as shown in FIG. 3.

The base member 72 may be extruded of a thermoplastic material such as rigid vinyl in the cross-sectional shape shown in FIG. 7. The wall 74 of the corner portions 78 and 82 is spaced from the wall of the hollow end 16 of the post 14 to provide a clearance distance D between the ends of the pipes 32' and 34' and the post. This clearance distance D may be about one-quarter inch. The length of the base member 72 is from about eighteen inches to about twenty-four inches depending upon the size of the post 14'. The base member 72 is installed and removed in a manner similar to the installation and removal of the base member 18 described hereinabove.

Figure 8:
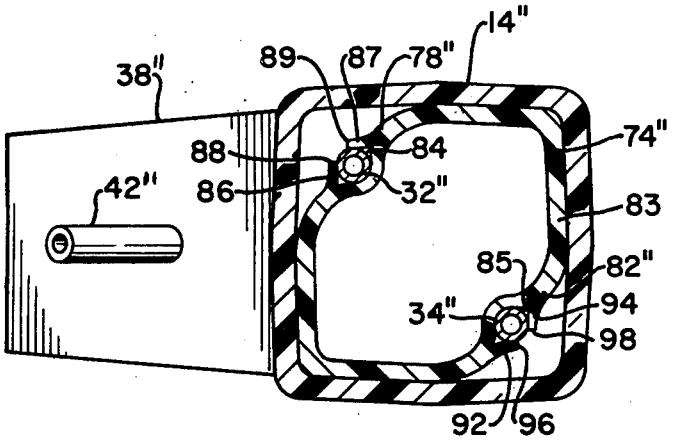
FIG. 8 is a fragmentary view like FIG. 2 showing another alternative form of base member.

Referring to FIG. 8, a second alternative base member 83 is shown having a hollow, generally rectangular cross section with a supporting wall 74'' like the wall 74 of the first alternative base member 72. Longitudinally extending openings 84 and 85 in the wall 74'' at the corner portions 78'' and 82'', respectively, are provided by a different construction than that of the base member 83. In this modification, the wall 74'' has flanges 86 and 87 at corner 78'' which extend outwardly around the opening 84 but have edges 88 and 89 which are spaced apart to facilitate molding of the base member 83. The flanges 86 and 87 with the wall 74'' define the opening 84. At the opposite corner 82 the wall 74'' has flanges 92 and 94 which extend outwardly around the opening 85 but have edges 96 and 98 which are spaced apart. The flanges 92 and 94 with the wall 74'' define the opening 85. Elongated base supporting members such as pipes 32'' and 34'' are disposed in the openings 84 and 85 and may be driven into the ground in the same manner as pipes 32 and 34.

The second alternative base member 83 may be extruded but is preferably molded of a thermoplastic material such as rigid vinyl in the cross-sectional shape shown in FIG. 8. The relationship of the base member 83 to the post 14'' is similar to the relationship of the first alternative base member 72 to the post 14'. Also the length of the base member 83 is the same as the length of the base member 72 for different size post assemblies.

It is understood that other modifications may be made to the post assembly 10 as described hereinabove. For example, the anchor tab 38 may be of a larger size and have more than one opening 40 for placing more than one pipe 42 into the ground 36 at different angles A to the vertical and in different directions. Also the base member 18 may have openings in the other two arms 22 and 26 for receiving two more pipes like pipes 32 and 34.

While certain representative embodiments and details have been shown for the purpose of demonstrating the invention, it will be apparent to those skilled in the art that various changes and modifications may be made therein without departing from the spirit or scope of the invention.

I claim:

1. A portable post assembly for mounting vertically on an earthen surface comprising a post member having a hollow end with a generally square cross section, a base member slidably positioned in said hollow end, said base member having at least two openings positioned in diagonally opposite corners of said hollow end and elongated removable base supporting members removably disposed in said openings for movement through said openings and extending beyond said post member for penetration into the earthen surface and at least one removable post securing member removably engageable with said post member for preventing movement of said base member out of said hollow end.

2. A post assembly according to claim 1 wherein said post securing member is engageable with an anchor tab projecting from said post, said anchor tab having at least one opening and said post securing member extending through said opening for penetration of the earthen surface.

3. A post assembly according to claim 1 wherein said base member has a cruciform cross section with arm members extending into diagonally opposite corners of said hollow end and said arm members being connected at a central portion.

4. A post assembly according to claim 1 wherein said base member has a hollow, generally rectangular, cross section with a supporting wall over which said hollow end is disposed and said openings being located in said wall at diagonally opposite corner portions of said base member.

5. A post assembly according to claim 4 wherein said wall has flanges with spaced-apart edges to facilitate molding of said base member.

6. A post assembly according to claim 4 or 5 wherein said openings at said corner portions are spaced from the wall of said hollow end of said post to provide clearance for said base supporting members.

7. A portable post assembly for mounting vertically on an earthen surface comprising a post member having a hollow end with a generally square cross section, a base member slidably positioned in said hollow end, said base member having at least two openings positioned in spaced-apart locations within said hollow end and elongated removable base supporting members removably disposed in said openings for movement through said openings and extending beyond said post member for penetration into the earthen surface and at least one removable post securing member removably engageable with said post member for preventing movement of said base member out of said hollow end.

8. A post assembly according to claim 7 wherein said post has a generally square cross section and sides bowed out at the midcenter planes to provide stiffening and mold release thereof.

* * * * *

UNITED STATES PATENT OFFICE

CERTIFICATE OF CORRECTION

Patent No. 4,441,679 Dated April 10, 1984

Inventor(s) Rudolph J. Calet

It is certified that error appears in the above-identified patent and that said Letters Patent are hereby corrected as shown below:

Column 5, line 5, should read --2. A post assembly according to claim 7 wherein said--.

Signed and Sealed this

Fourteenth Day of August 1984

[SEAL]

Attest:

GERALD J. MOSSINGHOFF

Attesting Officer

Commissioner of Patents and Trademarks